US011174139B2

(12) United States Patent
Stapensea et al.

(10) Patent No.: US 11,174,139 B2
(45) Date of Patent: Nov. 16, 2021

(54) LIFTING SYSTEM FOR LIFTING A VEHICLE COMPRISING ONE OR MORE LIFTING DEVICES AND A RELEASE SYSTEM, AND METHOD THERE FOR

(71) Applicant: Stertil B.V., Kootstertille (NL)

(72) Inventors: Jan Bernhard Stapensea, St. Annaparochie (NL); Ulbe Gerrit Bijlsma, Nes (NL)

(73) Assignee: Stertil B.V., Kootstertille (NL)

( * ) Notice: Subject to any disclaimer, the term of this patent is extended or adjusted under 35 U.S.C. 154(b) by 434 days.

(21) Appl. No.: 14/903,412

(22) PCT Filed: Jul. 3, 2014

(86) PCT No.: PCT/NL2014/050438

§ 371 (c)(1),
(2) Date: Jan. 7, 2016

(87) PCT Pub. No.: WO2015/005771

PCT Pub. Date: Jan. 15, 2015

(65) Prior Publication Data

US 2016/0152454 A1 Jun. 2, 2016

Related U.S. Application Data

(60) Provisional application No. 61/844,616, filed on Jul. 10, 2013.

(30) Foreign Application Priority Data

Jul. 10, 2013 (NL) ..... 2011131

(51) Int. Cl.
*B66F 3/46* (2006.01)
*B66F 7/28* (2006.01)
(Continued)

(52) U.S. Cl.
CPC ..... *B66F 3/46* (2013.01); *B66F 7/0666* (2013.01); *B66F 7/0691* (2013.01); *B66F 7/16* (2013.01);
(Continued)

(58) Field of Classification Search
CPC ..... B66F 3/46; B66F 7/28; B66F 7/16; B66F 17/00; B66F 9/20; B66F 7/0666;
(Continued)

(56) References Cited

U.S. PATENT DOCUMENTS 5,859,779 A * 1/1999 Giordano ..... G06Q 20/341 700/231
6,634,461 B1 * 10/2003 Baker ..... B66F 3/46 187/210
(Continued)

FOREIGN PATENT DOCUMENTS

EP 2163506 B1 12/2012
GB 837852 6/1960
(Continued)

OTHER PUBLICATIONS

Stertil-Koni Mobile Column Lifts cabled Found at: https://www.youtube.com/watch?v=01dY476IVE (Year: 2015).*
(Continued)

*Primary Examiner* — Mahdi H Nejad
(74) *Attorney, Agent, or Firm* — The Webb Law Firm

(57) ABSTRACT

Lifting system for lifting a vehicle and a method there for. The system comprises one or more lifting devices, wherein each lifting device includes: a frame with a carrier configured for carrying the vehicle; a drive for driving the carrier in at least one of the ascent or decent of the carrier; a sensor for measuring at least one of the ascent or descent of the carrier; and a controller including: a connection for connect-
(Continued)

ing to the sensor; a release system for releasing the carrier enabling the lifting system to lift the vehicle.

17 Claims, 11 Drawing Sheets

(51) Int. Cl.

| | |
|---|---|
| ***B66F 7/20*** | (2006.01) |
| ***B66F 17/00*** | (2006.01) |
| ***B66F 7/06*** | (2006.01) |
| ***B66F 9/20*** | (2006.01) |
| ***B66F 7/16*** | (2006.01) |

(52) U.S. Cl.
CPC ..... *B66F 7/20* (2013.01); *B66F 7/28* (2013.01); *B66F 9/20* (2013.01); *B66F 17/00* (2013.01)

(58) Field of Classification Search
CPC .. B66F 7/20; B66F 7/0691; B66F 7/10; B66F 13/00; B66F 5/00; B66F 9/24; B66F 7/04; H04B 7/24
USPC ..... 254/89 R; 269/89
See application file for complete search history.

(56) References Cited

U.S. PATENT DOCUMENTS 6,651,778 B1 * 11/2003 Manning ..... F01M 11/0458 184/1.5
8,890,475 B1 * 11/2014 Becker ..... B60L 11/1827 320/109
9,568,029 B2 * 2/2017 Lemke ..... B66F 3/30
10,065,842 B2 * 9/2018 Jaipaul ..... B66F 3/46
RE47,686 E * 11/2019 Wilson, II ..... G06Q 40/08
2003/0024132 A1 * 2/2003 Kokura ..... B66F 9/0755 33/712
2004/0034538 A1 * 2/2004 Fenelon ..... G06Q 99/00 705/308
2006/0052980 A1 * 3/2006 LaFollette ..... G01G 19/02 702/173
2007/0208476 A1 * 9/2007 Baginski ..... B66F 9/0755 701/50
2008/0014059 A1 * 1/2008 Jones ..... E04H 6/14 414/227
2008/0281664 A1 * 11/2008 Campbell ..... G06Q 10/02 705/5
2009/0265059 A1 * 10/2009 Medwin ..... B66F 9/0755 701/31.4
2010/0045323 A1 * 2/2010 Nappen ..... B66F 7/16 324/756.01
2010/0066278 A1 3/2010 De Jong
2010/0204876 A1 * 8/2010 Comeau ..... G07C 5/008 701/29.6
2010/0288569 A1 * 11/2010 Fish ..... B60K 1/00 180/65.29
2011/0037041 A1 2/2011 DeJong et al.
2011/0130865 A1 * 6/2011 Setzer, Sr. ..... B66F 9/08 700/213
2011/0251935 A1 * 10/2011 German ..... B60S 5/06 705/30
2012/0048653 A1 * 3/2012 Matthews ..... B66F 7/0691 187/211
2012/0160604 A1 6/2012 Bowden
2013/0020779 A1 * 1/2013 Green ..... A61G 5/1067 280/200
2013/0240300 A1 * 9/2013 Fagan ..... B66F 3/46 187/210
2013/0240812 A1 * 9/2013 Helmich ..... B66F 3/46 254/89 H
2014/0076665 A1 * 3/2014 Nussbaum ..... B66F 7/20 187/203
2014/0089078 A1 * 3/2014 Dessert ..... G06Q 30/0238 705/14.38
2014/0277958 A1 * 9/2014 Yahner ..... B66F 9/0755 701/50
2015/0175397 A1 * 6/2015 Lynn ..... B66F 17/003 187/222

FOREIGN PATENT DOCUMENTS

GB 2472441 A 2/2011
WO 2009099322 A1 8/2009

OTHER PUBLICATIONS

61970703,Specification,Mar. 26, 2014 (for Pat. 10065842_Fagan) (Year: 2014).*
Linear Velocity Sensors Selection Guide _ Engineering360 (Year: 2020).*

* cited by examiner

LIFTING SYSTEM FOR LIFTING A VEHICLE COMPRISING ONE OR MORE LIFTING DEVICES AND A RELEASE SYSTEM, AND METHOD THERE FOR

CROSS-REFERENCE TO RELATED APPLICATIONS

This application is the United States national phase of International Application No. PCT/NL2014/050438 filed Jul. 3, 2014, and claims priority to Netherlands Patent Application No. 2011131 filed Jul. 10, 2013, and U.S. Provisional Patent Application No. 61/844,616, filed Jul. 10, 2013, the disclosures of which are hereby incorporated in their entirety by reference.

BACKGROUND OF THE INVENTION

Field of the Invention

The invention relates to a vehicle lifting system and more specifically to a system comprising one or more moveable lifts or lifting devices such as lifting columns, and a release system. In general, lifting systems are specifically used for lifting trucks and busses, or other vehicles and may involve lifting columns of the two-post lift type with pivoting support arms, the four-post lift type with runways, the mobile type, in-ground lifts etc.

Description of Related Art

A lifting column known from practice comprises a frame with a carrier that is connected to a drive for moving the carrier upwards and downwards. In the ascent mode, hydraulic oil is pumped to a cylinder for lifting the carrier and, therefore, the vehicle. In the descent mode, the carrier with the vehicle is lowered and hydraulic oil returns to the reservoir. Such prior art lifting system is disclosed in U.S. Patent Application Publication No. 2006/0182563, which is incorporated herein by reference.

Known systems for lifting and lowering a vehicle often include a number of lifting columns. These systems can often be used freely by a user. In some of these conventional systems a user requires an identification enabling the user to control the lifting system. Although this identification of the user enables monitoring the user, and to some extent guarantees the use of the lifting system by authorised personnel only, the correct use of the lifting system by an identified and/or authorised user cannot be guaranteed under substantially all circumstances. In practice this may lead to unneeded lifting operations or even undesired lifting operations that may reduce the life span of the lifting system and/or increase maintenance costs. In addition, undesired lifting operations may even lead to safety concerns. Furthermore, there is no monitoring and/or control of the lifting system in view of the relation between lifting costs of the lifting system as a whole and an individual lifting operation for a specific vehicle, for example.

An object of the invention is to obviate or at least reduce some of the above problems.

SUMMARY OF THE INVENTION

This object is achieved with a lifting system for lifting a vehicle according to the invention, the vehicle lifting system comprising one or more lifting devices, the system comprising:

- a frame with a carrier configured for carrying the vehicle;
- a drive for driving the carrier in at least one of the ascent or decent of the carrier;
- a sensor for measuring at least one of the ascent or descent of the carrier; and
- a controller comprising:
  - a connection for connecting to the sensor;
  - a release system for releasing the carrier enabling the lifting system to lift the vehicle.

Lifting devices of the lifting system according to the invention include lifting columns of the two-post lift type with pivoting support arms, the four-post lift type with runways, the mobile type lifting columns, in-ground lifts etc.

As an example, in an embodiment of a lifting system according to the invention, at least two lifting columns are being used as lifting devices. In fact, often four lifting columns are being used. During such lifting operation, the timing of these separate lifting columns and, according to the invention especially the moving speed of the carrier that carries (part of) the vehicle when lifting a vehicle, requires synchronization. The control preferably comprises a system controller that synchronizes the height of the separate carriers in the ascent mode using, for example, a measurement signal generated by a height sensor, for example, a potentiometer. Of course, other sensors can also be used. In case one of the carriers has moved too fast in the ascent mode and is too high as compared to the other carriers of the other lifting columns the power supply to this carrier is either directly or indirectly lowered so that the other carriers can catch up or, alternatively, the power supply to the other carriers is either directly or indirectly increased so that the other carriers can catch up. In the descent mode, it is also important that the height of the carriers between the several lifting columns is synchronized. Therefore, in case one of these carriers has moved too slowly its power supply is increased in order for this carrier to catch up with the other carriers or, alternatively, the power supply to the other carriers is either directly or indirectly lowered so that the other carriers can catch up.

According to the invention a sensor measures directly or indirectly the ascent or descent of the carrier. Preferably, the sensor comprises an activity sensor, including an embodiment wherein the sensor is embodied as activity sensor, wherein the activity sensor is configured for providing the controller with information on the actual use of the lifting system. For example, such (activity) sensor may involve one or more of the sensors: displacement sensor, load sensor, pump activity sensor, motor runtime sensor, activity sensor for switches and/or buttons. This provides information on the actual use of the lifting system according to the present invention. More specifically, the sensor provides information by directly or indirectly sensing (vertical) movement of the carrier. Furthermore, the lifting system comprises a controller that comprises a connection for connecting the controller to the sensor. This connection can be wired or wireless. The controller can be physically attached to one or more of the individual lifting devices and/or be centrally provided and communicate wired or wirelessly with the different components of the lifting system according to the present invention. The controller is furthermore provided with a release system for releasing the carrier. After the carrier has been released the lifting system is capable of being used by a user for lifting a vehicle. The release system may involve locking and/or unlocking means. Examples thereof include software locks locking the use of a pump or motor and hardware locks physically blocking movement of the carrier.

Providing a release system enables a direct control and/or monitoring of the lifting system according to the present invention. In use, this is preferably combined with an identification and/or authorisation of the user that is working with this lifting system. This enables a close watch of the lifting system thereby improving maintenance operations, for example. In addition, by providing a release system the number of lifts can be monitored closely and undesired and/or unneeded lifts can be prevented.

Furthermore, monitoring the movements of the lifting system and providing the release system enables a direct coupling of a lifting operation for a specific vehicle to the costs associated with using the lifting system according to the present invention. This also enables direct debiting of the vehicle owner for usage of the lifting system, a type of so-called pay-per-lift debiting system.

In a presently preferred embodiment according to the present invention the controller comprises an input for receiving a clearance signal from a clearance system.

By providing a clearance system the lifting system can be provided with a clearance signal such that the lifting system can be put into operation. After receipt of the clearance signal the release system may release the lifting system, for example by releasing the carrier thereof, thereby enabling a lifting operation. The clearance signal can be sent to the input of the controller by the clearance system that can be physically located attached to or adjacent the lifting system or also remotely. The clearance signal can be sent to the controller through a wired connection or a wireless connection.

In a preferred embodiment the clearance system generates a clearance signal after receiving a payment for performing the required lifting operation. This payment can be received through a pre-paid card that is offered to the lifting system directly at the lifting device and/or at the clearance system. Alternatively, or in addition thereto, the clearance system provides an authorisation to perform a number of lifting operations, optionally in a specific time period. Furthermore, the clearance system may send a clearance signal and collect the data such that debit information can be provided to the accountant/billing department and/or debit the client directly. This enables a direct coupling of the lifting operation to the (end)-user. This renders the use of the lifting system according to the present invention cost controlled, thereby further preventing undesired and/or unneeded lifting operations. Furthermore, this provides the opportunity and possibility for operational leasing or renting the lifting system according to the present invention and pay for a specific lifting operation as an alternative to, or in addition to, a payment for the lifting system as such.

In a presently preferred embodiment according to the present invention the sensor comprises a displacement sensor for measuring a displacement of the carrier.

By providing a displacement sensor a movement of the carrier can be detected. This information can be used by the controller to cost effectively control the lifting system according to the present invention. Such displacement sensor can be a potentiometer and/or an inclinometer, for example. The sensor provides feedback to the controller that the requested lifting operation has been started and/or is completed.

In a presently preferred embodiment the sensor comprises a load sensor. This enables coupling the actual load that is put on the carrier to the specific use of the lifting system for a specific vehicle and/or end-user such as the vehicle owner. This is a further step to the pay-per-lift system as the actual load that is put on the carrier of the lifting system can be taken into account such that the actual payment can be adjusted for the load.

In a further preferred embodiment of the present invention the sensor comprises a pump activity sensor. This pump activity sensor enables detecting the status of the pump. When the pump is active, hydraulic oil will be provided to a cylinder that may act as a drive for driving the carrier. Alternatively, or in addition thereto, the sensor may comprise a motor runtime sensor. Such a motor runtime sensor provides information over the actual status of the motor and the motor runtime as a measure for the use of the lifting system according to the present invention. Alternatively, or in addition thereto, the sensor may comprise an activity sensor determining the position of the lifting and/or lowering switch or button.

It will be understood that the sensor may comprise one of the sensors mentioned above as well as a combination of two or more of these sensors.

In a further preferred embodiment according to the present invention, the lifting system comprises a vehicle detector.

By providing a vehicle detector the type of vehicle can be detected. This information can be used by the controller to adjust the settings of the lifting system. In addition thereto, this information can be used by the release system and/or clearance system to provide additional information and improve the operation of the entire lifting system. This may involve use of this information for sending payment instructions. The vehicle detector may comprise a camera or camera system. Alternatively, or in addition thereto, the vehicle detector may comprise other detector means such as a RFID system with a reader for reading a RFID-tag provided in a vehicle.

Optionally, a camera system and/or other vehicle detector is used for vehicle recognition such that the operational costs for the lifting operation can be linked to a specific vehicle. For example, this recognition of a specific vehicle can be performed through the license plate number that can be recognised by the camera.

In a presently preferred embodiment according to the present invention the controller comprises a transmitter and/or receiver for remotely controlling the release system.

By remotely controlling the release system a remote control can be performed. This may involve remotely providing a release signal and/or clearance signal. This enables the use of one controller or control system for a number of lifting systems. This is especially advantageous for a work shop, for example.

In a presently preferred embodiment according to the invention the controller comprises a communication optimiser for determining an appropriate communication route in the lifting system.

By providing a communication optimiser the system may choose between several available communication routes in the lifting system between individual lifting devices, such as lifting columns. These available routes may involve direct communication between the sending lifting device and the intended receiving lifting device. Alternative routes may involve indirect routes via other, intermediate lifting devices. Use can be made of one or more intermediate lifting device. This enables communication in a type of mesh-network communication configuration. An intermediate lifting device receives the communication message and forwards it. In a presently preferred embodiment the intermediate lifting device does not perform any further action with the communication. The choice for a specific route can be made by the group controller and/or can be made automatically depending on whether the intended receiving lifting device has actually received the communication. For example, in absence of a receipt confirmation of the intended receiving lifting device within a specified time period alternative routes can be used. Optionally, all routes are initially used and sending/broadcasting/forwarding communication is stopped after a receipt confirmation has been broadcasted by the intended receiving lifting device. It will be understood that other protocols can also be used in accordance with the present invention.

The invention further relates to a method for controlling a lifting system as described above for lifting a vehicle, the method comprising the steps:

providing a lifting system according to one or more of the foregoing clauses; and controlling the lifting system with the controller and providing a release signal to the lifting system releasing the carrier with the release system thereby enabling the lifting system to lift the vehicle.

The same effects and advantages apply for the method as described for the system. In a presently preferred embodiment the release signal is provided after a clearance signal has been received from a clearance system. In one of the possible embodiments a release signal is generated directly at the lifting system according to the present invention, while the clearance signal is generated remotely by the clearance system. This clearance system preferably provides the clearance signal in response to receiving and/or generating debiting instructions. This may involve the use of pre-paid cards, generating debiting instructions etc. In a possible embodiment according to the invention the clearance signal actually comprises a payment. An example of such payment is the use of a pre-paid card and/or payment by mobile phone. Optionally, this payment is directly made at the lifting system. This enables a direct coupling between an individual lifting operation and the cost/payments for the use thereof.

In a further preferred embodiment the method involves using an optimal communication route involving either direct communication between the sending and intended receiving lifting device, or indirect communication via one or more intermediate lifting devices. Such optimal mesh network configuration provides an improved robustness when communicating within the lifting system.

It is noted that features mentioned in relation to the system can be applied to the method according to the invention, and vice versa.

BRIEF DESCRIPTION OF TILE DRAWINGS

Further advantages, features and details and of the embodiment will be elucidated on the basis of preferred embodiments therefore wherein reference is made to the accompanying drawings, in which.

DETAILED DESCRIPTION OF THE INVENTION

Figure 1:
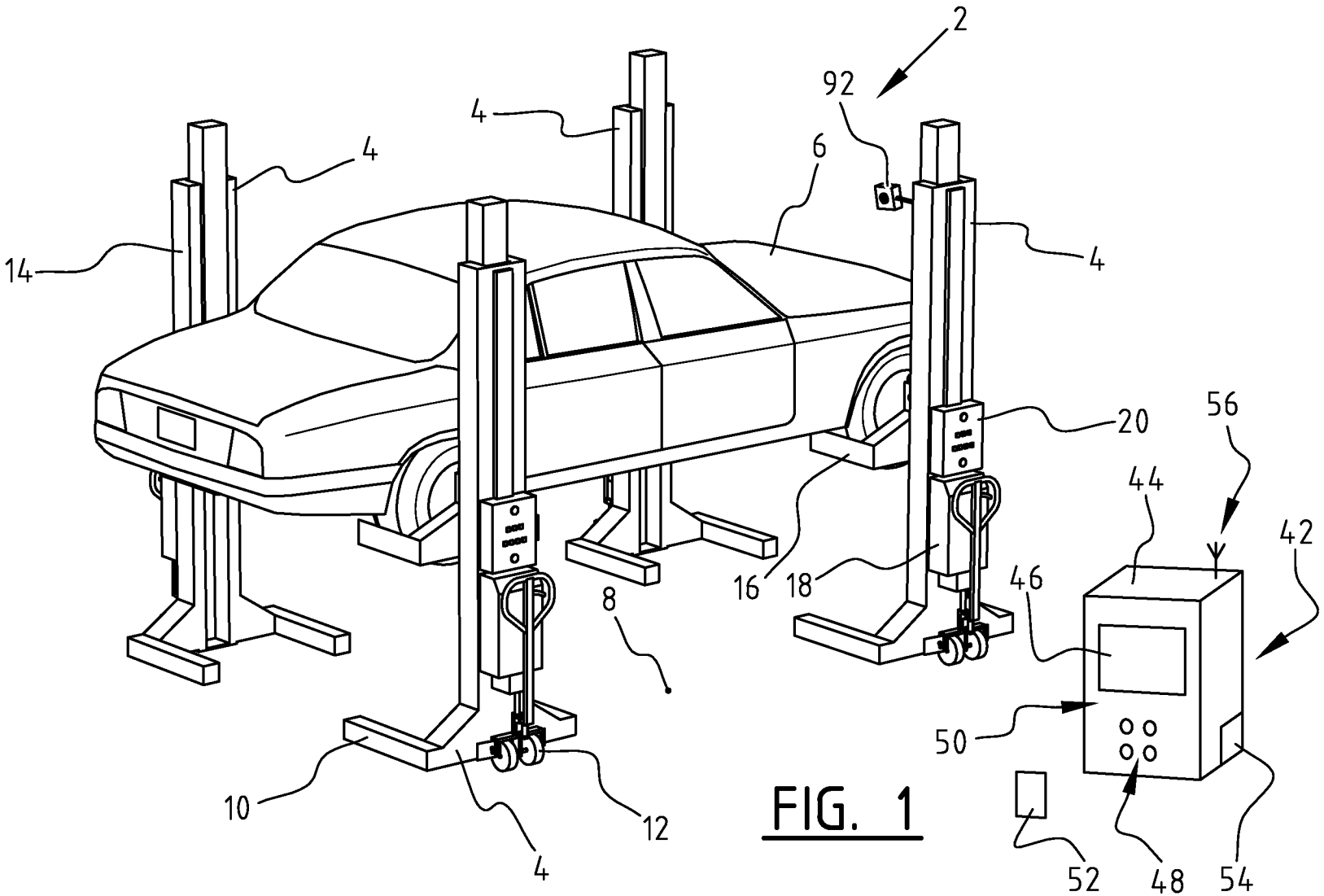
FIG. 1 shows a schematic overview of a vehicle lifted by lifting columns of a lifting system according to the invention.

The following description is merely exemplary in nature and is in no way intended to limit the invention, its application, or uses. While the disclosure is described as having exemplary attributes and applications, the present disclosure can be further modified. This application is therefore intended to cover any variations, uses, or adaptations of the disclosure using its general principles. Further, this application is intended to cover such departures from the present disclosure as come within known or customary practice of those skilled in the art to which this disclosure pertains and which fall within the limits of the appended claims. Accordingly, the following description of certain embodiments and examples should be considered merely exemplary and not in any way limiting.

The lift control system of the present invention is suitable for use with lift systems comprising any number of lifting devices that require height control columns, including without limitation scissor lifts and systems having one, two or four columns. The columns may achieve lifting and lowering capability by any means known to those of skill in the art, including hydraulically, electrically, mechanically, and electromechanically. Lift systems compatible with the present lift control system may be stationary and/or permanently affixed or attached to a certain location or may be mobile, capable of being transported via wheels or any other suitable means known to those in the art. With reference to the figures, like element numbers refer to the same element between drawings. A system 2 for efficient lifting and lowering a load (FIG. 1) comprises four mobile lifting columns 4 in the illustrated embodiment. Lifting columns 4 lift a passenger car 6 from the ground 8. Lifting columns 4 are connected to each other and/or a control system by wireless communication means or alternatively by cables. Lifting columns 4 comprise a foot 10 which can travel on running wheels 12 over ground surface 8 of for instance a floor of a garage or workshop. In the forks of foot 10 is provided an additional running wheel (not shown). Lifting column 4 furthermore comprises a mast 14. A carrier 16 is moveable upward and downward along mast 14. Carrier 16 is driven by a motor 18 that is provided in a housing of lifting column 4. Motor 18 is supplied with power from the electrical grid or by a battery that is provided on lifting column 4 in the same housing as motor 18, or alternatively on foot 10 (not shown). Control with control panel 20 is provided to allow the user of system 2 to control the system, for example by setting the speed for the carrier 16.

The illustrated lifting system 2 includes at least two lifting columns 4. Each of the lifting columns has at least one ascent mode and one descent mode, and is under the influence of a control 20. Control 20 can be designed for each lifting column 4 individually, or for the lifting columns 4 together.

Figure 2A:
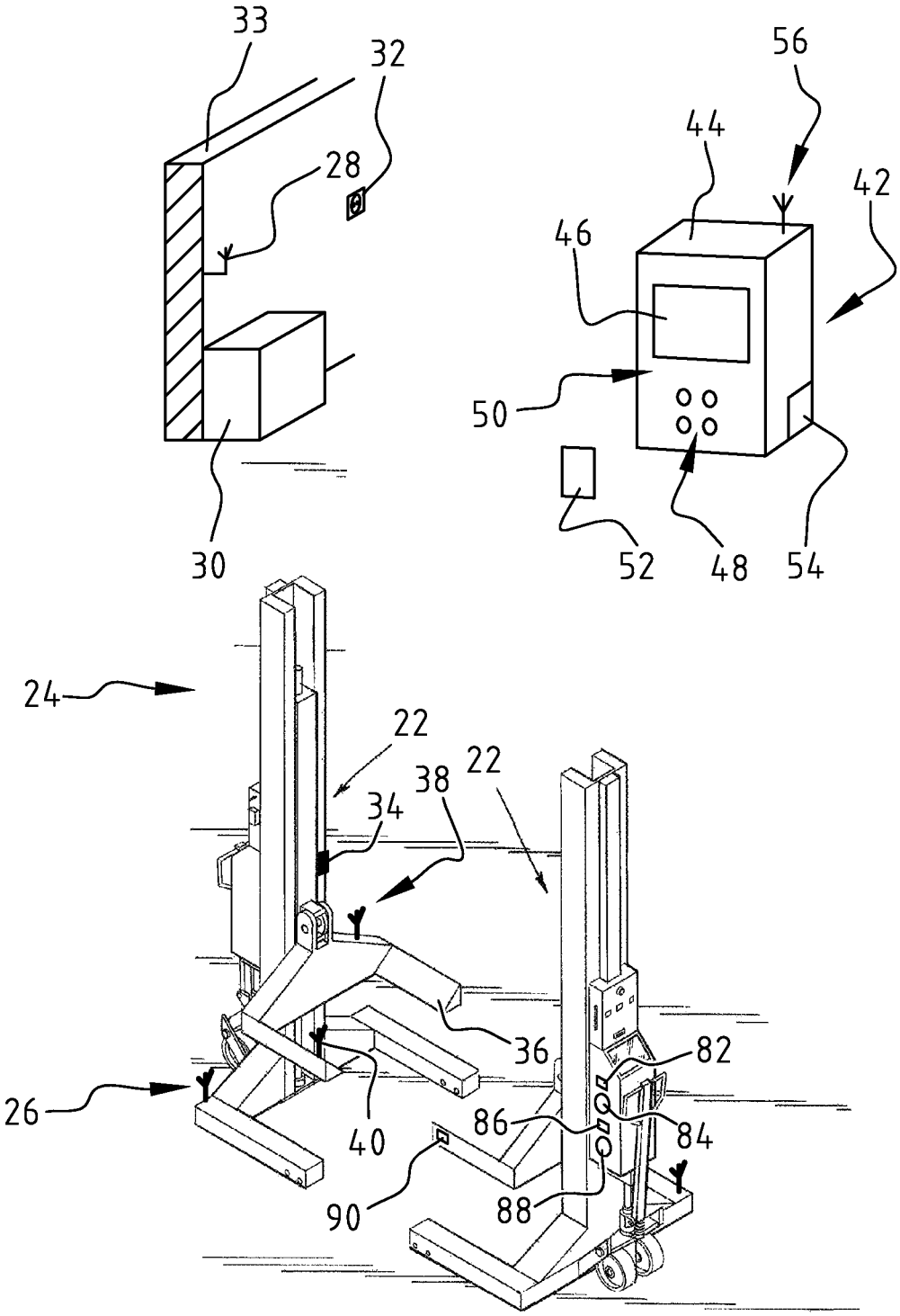
FIG. 2A shows a lifting column of a lifting system according to the invention.

An illustrated column 22 (FIG. 2A) of a lifting system 24 is a mobile lifting column that communicates by transmitter-receiver 26 to a transmitter-receiver 28 of a central controller 30. A connection 32 to the electrical grid is provided on a side wall 33 in the neighbourhood of controller 30. Sensor 34 is capable of measuring position and/or speed of carrier 16. The resulting measurement signal is communicated via transmitter 38 to transmitter-receiver 28 of controller 30 directly or indirectly through transmitter-receiver 26. Controller 30 may send data to lifting column 22 such as an activation signal for sensor 34 using transmitter-receiver 28 and receiver 40. In the illustrated embodiment sensor 34 is a potentiometer and/or an inclinometer.

It will be understood that transmitters and/or receivers 26, 38, 40 can be combined or separated. In the illustrated embodiments sensor 34 is a potentiometer.

Control system 42 operates as controller for the lifting devices, optionally in cooperation with controller 30, control 20 and/or other control components. In the illustrated embodiment control system 42 comprises housing 44, a display 46, preferably a touch screen, a number of buttons 48, an RFID antenna 50 enabling a user to identify himself with an ID-key 52 and/or pay for a number of lifts with a pre-paid card 52. Control system 42 further comprises position determining means 54 and communication means 56, preferably providing wireless functionality to communicate in one or more environments such as LAN, WAN, VPN intranet, internet etc., that are schematically shown in the illustrated embodiments. Control system 42 is further provided with input/output ports, such as USB, SD card reader, smart phone communication possibilities etc. to improve the functionality. The output may provide warning signals to the user. Display 46, preferably a TFT-LCD), is protected by a display lens cover of a resilient material, preferably scratch-resistant.

In the illustrated embodiment control system 42 provides a clearance signal to control 20, 30 that provides a release signal enabling the effective use of carrier 16, 36. The release signal may release a software lock preventing motor 84 and/or pump 88 to operate. Alternatively or in addition thereto release signal may release a hardware lock, for example a clamp locking carrier 16, 36. Payments are received via card 52, generating payment instructions and sending the instructions to the accounting department of the user and/or receiving an authorization signal authorizing the system and user to perform a number of lifts and/or use lifting system 2 for a specific period of time.

Figure 2B:
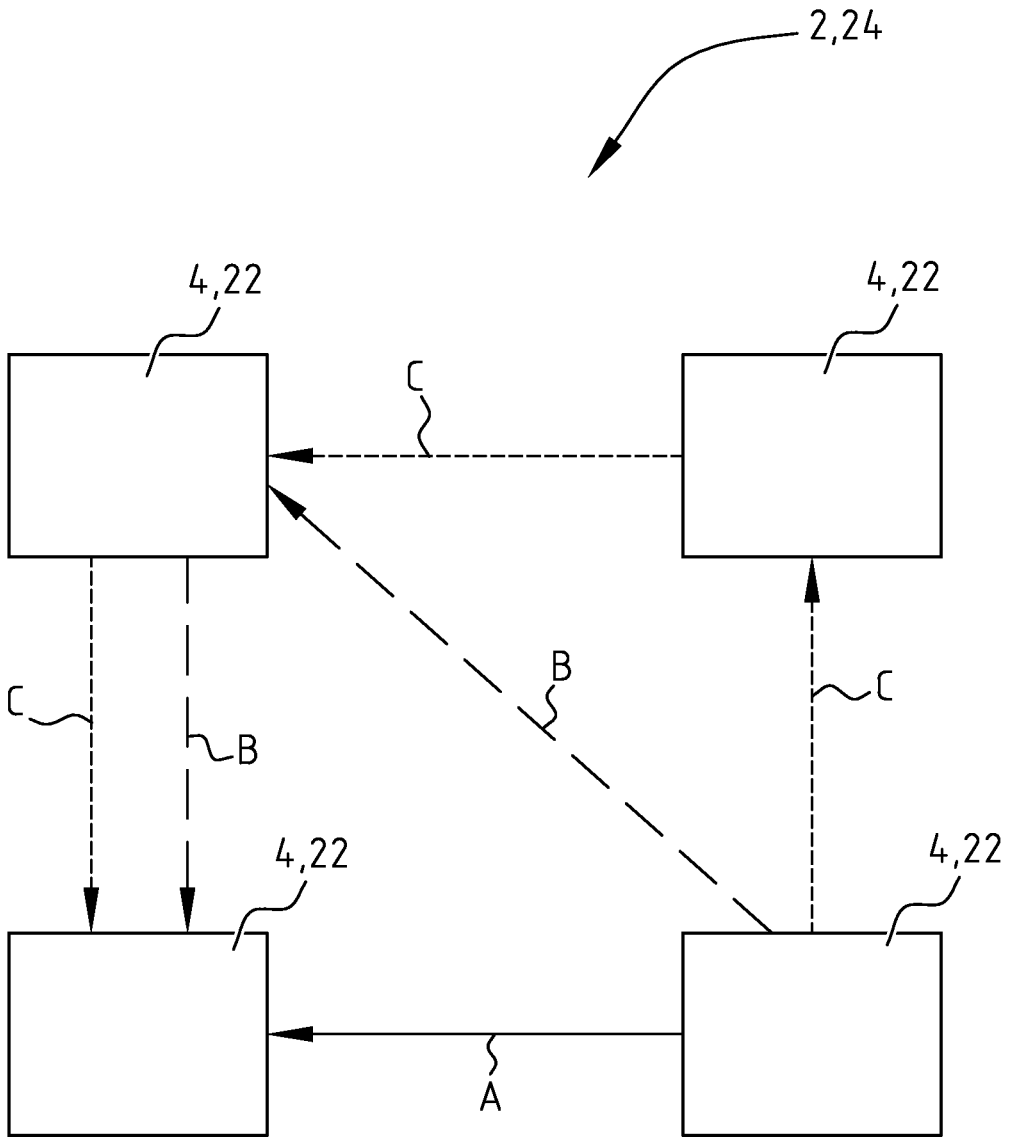
FIG. 2B shows communication routes in the lifting system comprising a number of lifting columns according to the invention.

Communication (FIG. 2B) between lifting columns 4,22 in a lifting system 2,24 may follow a number of different routes. For example, in case communication is required between two lifting columns a direct route A can be used for the communication. In case route A is blocked, hindered or otherwise disturbed an alternative indirect route B can be used for the communication. In this alternative route B another lifting column 4,22 receives and forwards the communication, preferably without reading, writing or performing any action on basis of the communication. In a similar manner another alternative indirect route C can be used involving two, or even more, intermediate lifting columns 4,22. The choice for a specific route A,B,C can be made by a (group) controller. Also, the receiving destination lifting column 4,22 may provide a "message received"-signal thereby ending communication via other routes. It will be understood that a skilled person would know several ways to correctly implement dealing with different routes for communication. The advantage of enabling more than one route for communication is that in case of signal disturbance of signal blocking communication may continue via alternative routes. This provides a robust and stable control of the lifting system 2,24 according to the invention.

Figure 3:
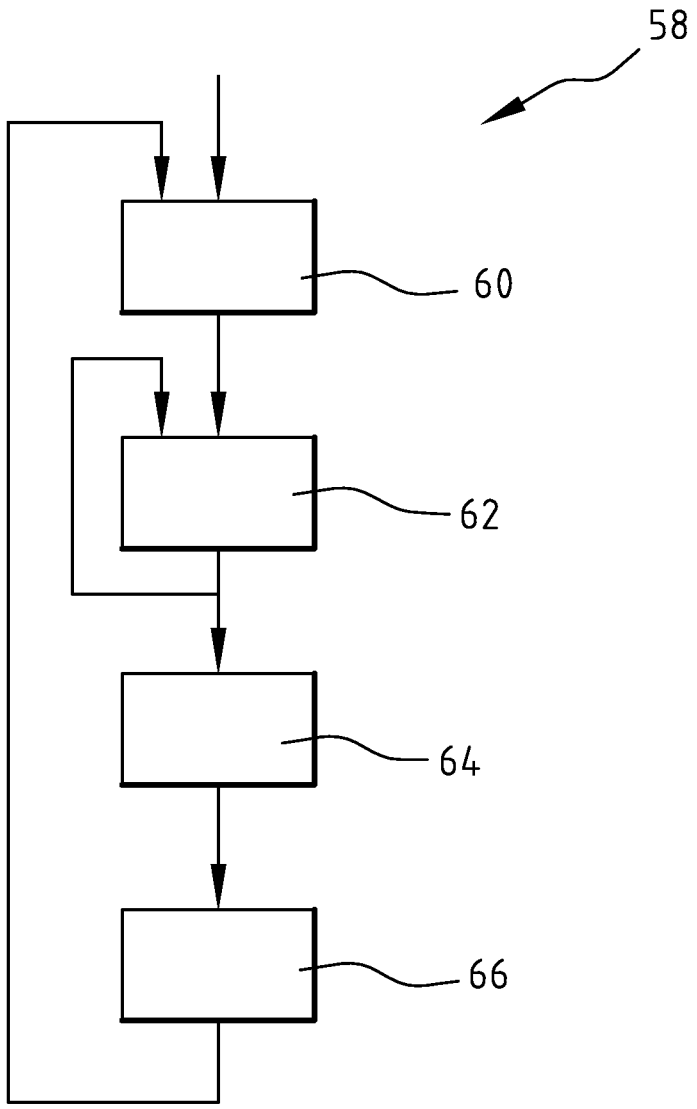
FIGS. 3-4 show a schematic overview of lifting operations according to the present invention.

Operation of lifting system 2 involves method 58 (FIG. 3) starting with initiation step 60. In clearance step 62 the clearance check is performed. In case clearance is confirmed system 2 is released by the release system in release step 64 and lifting step 66 can be started to perform the desired lifting.

Figure 4:
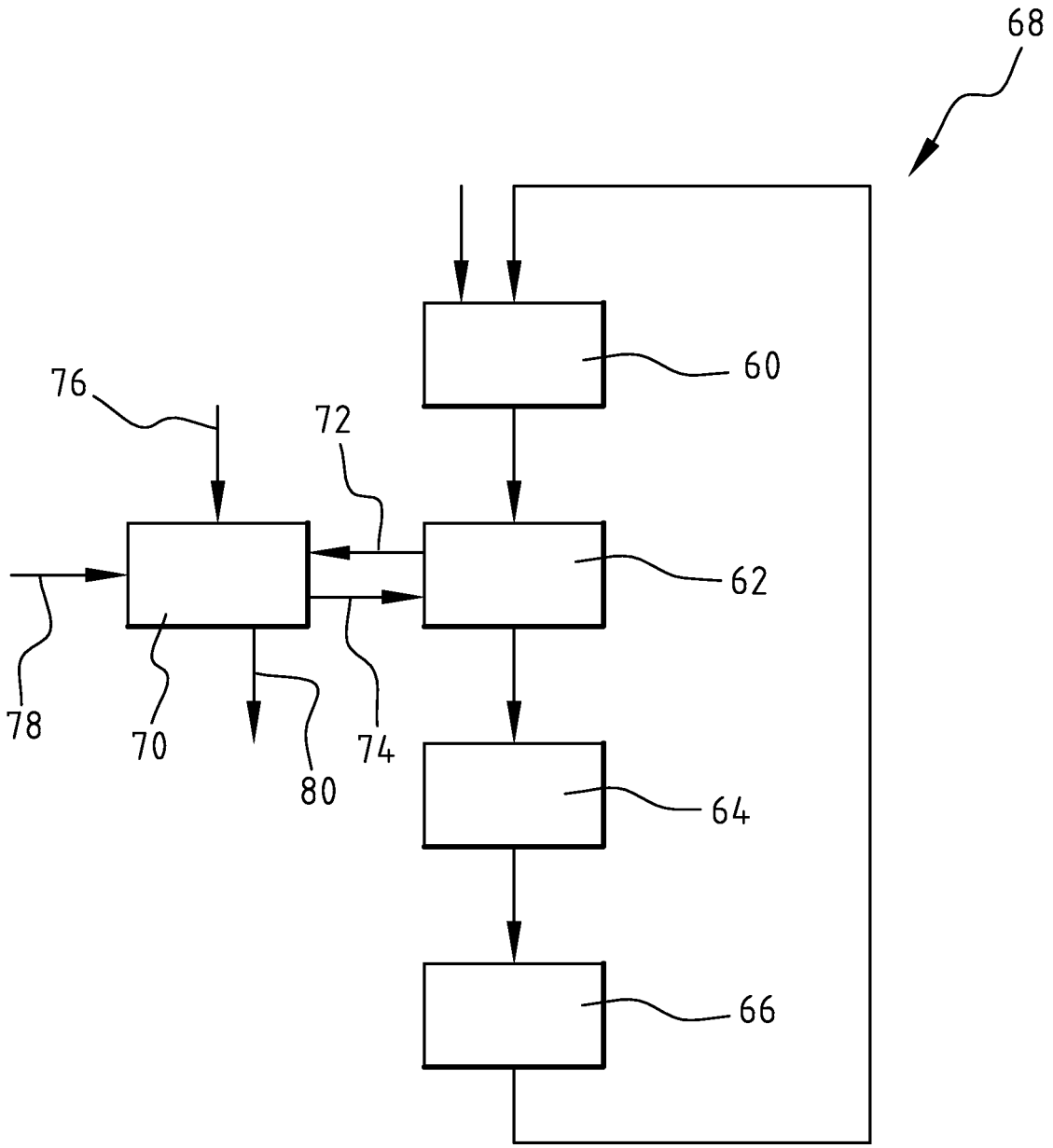

In an alternative method 68 (FIG. 4) clearance step 62 involves communication with a clearance system involving a requesting step sending a request 72 for an authorization to use lifting system 2 and/or a reply step receiving a reply 74 relating to the authorization or denial to use lifting system 2. In order to send any authorization and/or clearance signals clearance system receives payments, for example with a pre-paid lift card 52, or payment confirmations, for example via an automatic debit order 78, and/or sends payment instructions 80.

Sensor 34 can be used to inform controller 30 of lifting activities of carrier 16, 36. Alternatively, or in addition thereto, motor run time sensor 82 (FIG. 2.) may provide controller 30 with motor run time information of motor 84 and/or pump activity sensor 86 may provide controller 30 with pump activity information of pump 88 and/or load sensor 90 may provide controller 30 with information on the actual loads carried by carrier 16, 36, preferably in combination with the time period the carrier 16, 36 is exposed to the load.

Optionally, camera 92 (FIG. 1) provides information about the type of vehicle, such as a bus, truck or passenger car, to controller 20, 30 enabling the controller to adjust the settings of lifting system 2 and/or use vehicle specific information for debiting the user for the lifting operation that is performed. Optionally, camera 92 detects the vehicle registration, for example by the license plates, optionally providing the relevant information to the accounting department such that the vehicle owner can be debited for the actual lifting operation(s).

The present invention can be applied to the (wireless) lifting columns illustrated in FIGS. 1-2. Alternatively, the invention can also be applied to other types of lifting columns and lifting systems.

Figure 5:
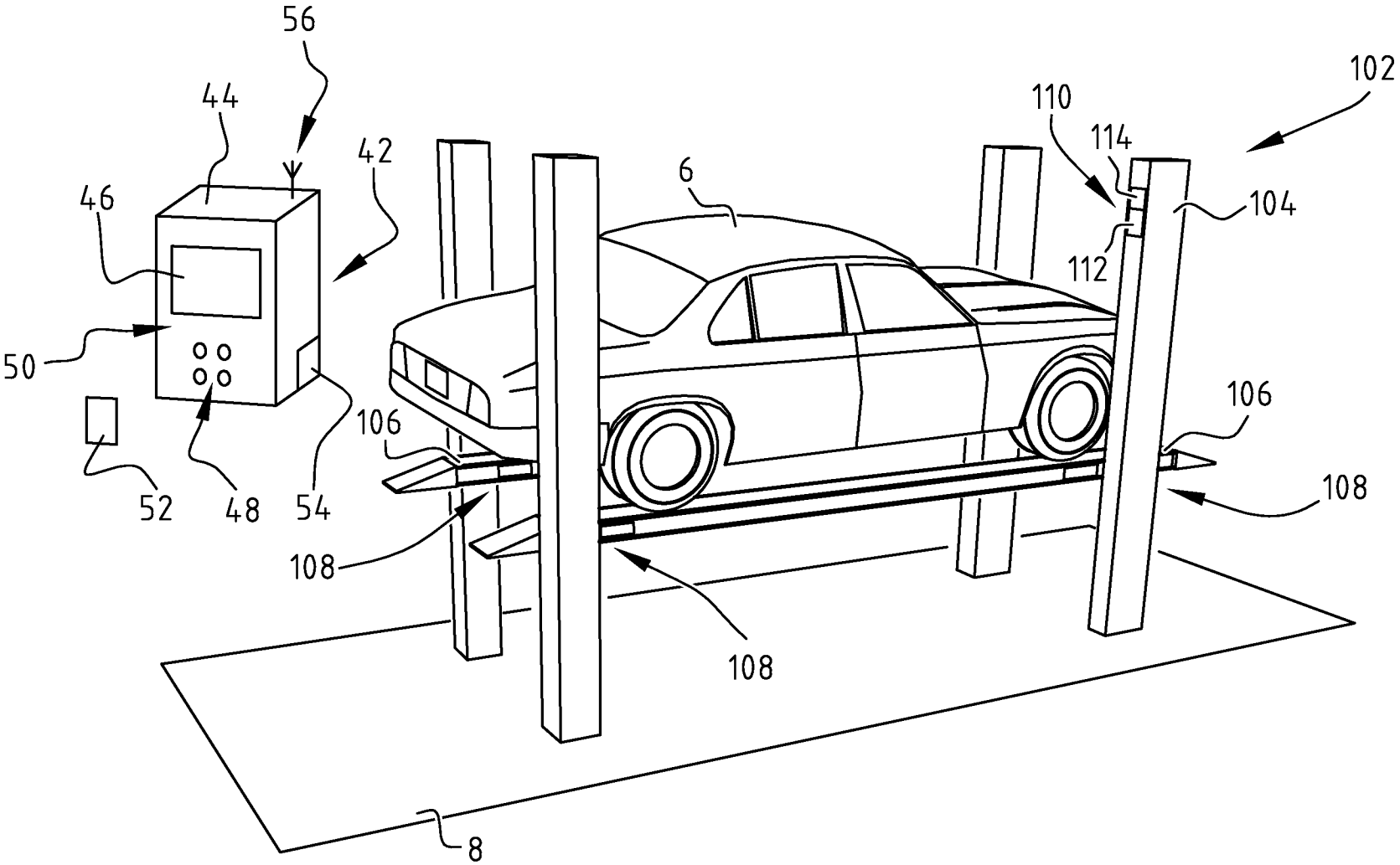
FIGS. 5-7 show alternative embodiments of lifting columns of lifting systems according to the invention.

For example, a four-post lifting system 102 (FIG. 5) comprises four columns 106 carrying runways 106. Columns 104 comprise a sensor 108, preferably each column 104 has one sensor 108. In the illustrated embodiment an indicator 110 with a green light 112 and a red light 114 is provided. Light 110 signals to the driver when vehicle 6 is positioned correctly relative to columns 104 and the vehicle 6 can be lifted. In case each column 104 is provided with sensor 108 the position of the carrier 106 can be checked. This contributes to the overall safety of the lifting operation.

Figure 6:
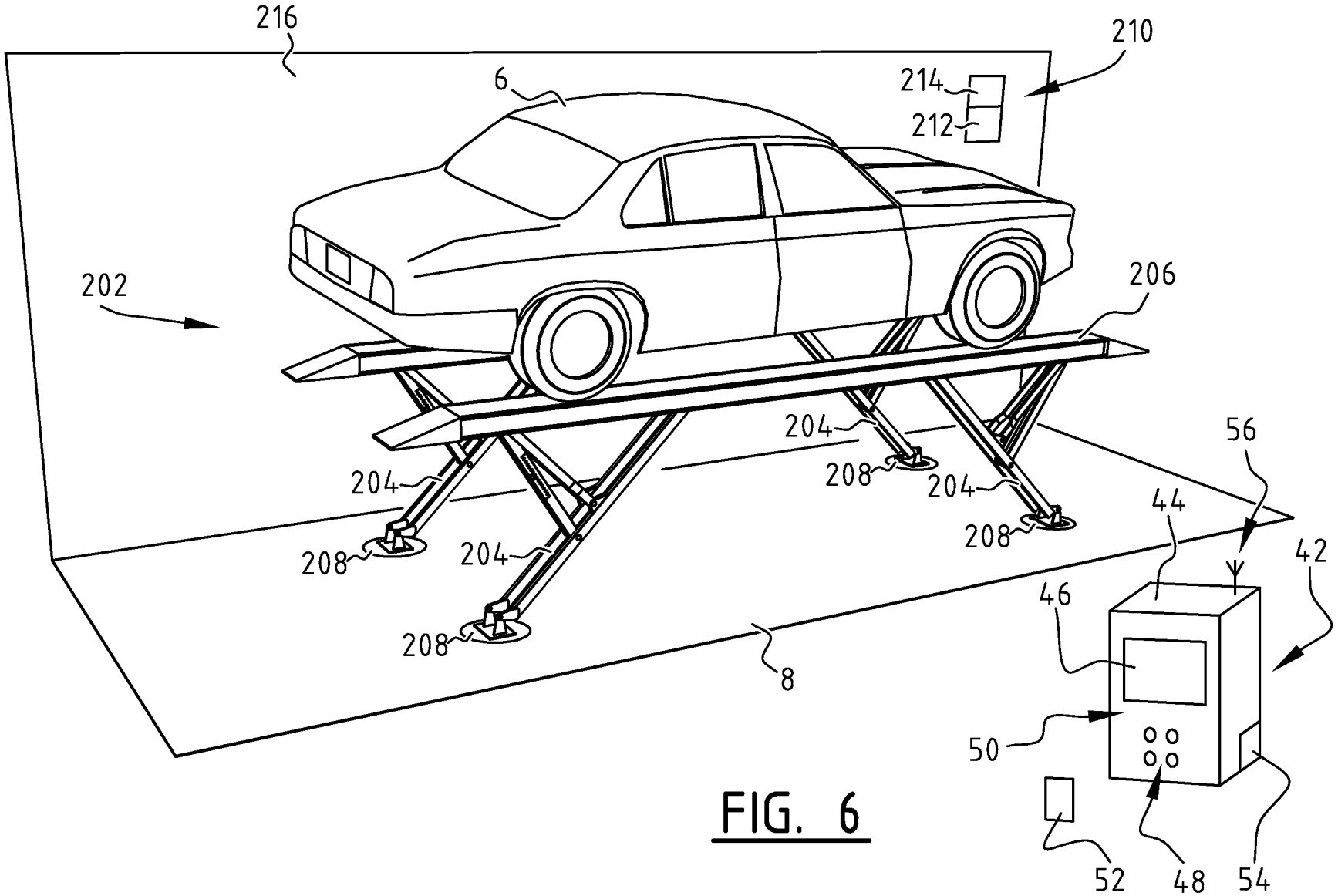

As a further example, lifting system 202 (FIG. 6) comprises a so-called sky-lift configuration with four posts 204 carrying runways 206. In the illustrated embodiment a sensor 208 is provided for every post 204. This enables the check on positioning of the carrier as described earlier. A light 210 with green 212 and red 214 lights can be provided on wall 216 to indicate to the driver of vehicle 6 that the vehicle is positioned correctly or needs to be repositioned.

Figure 7:
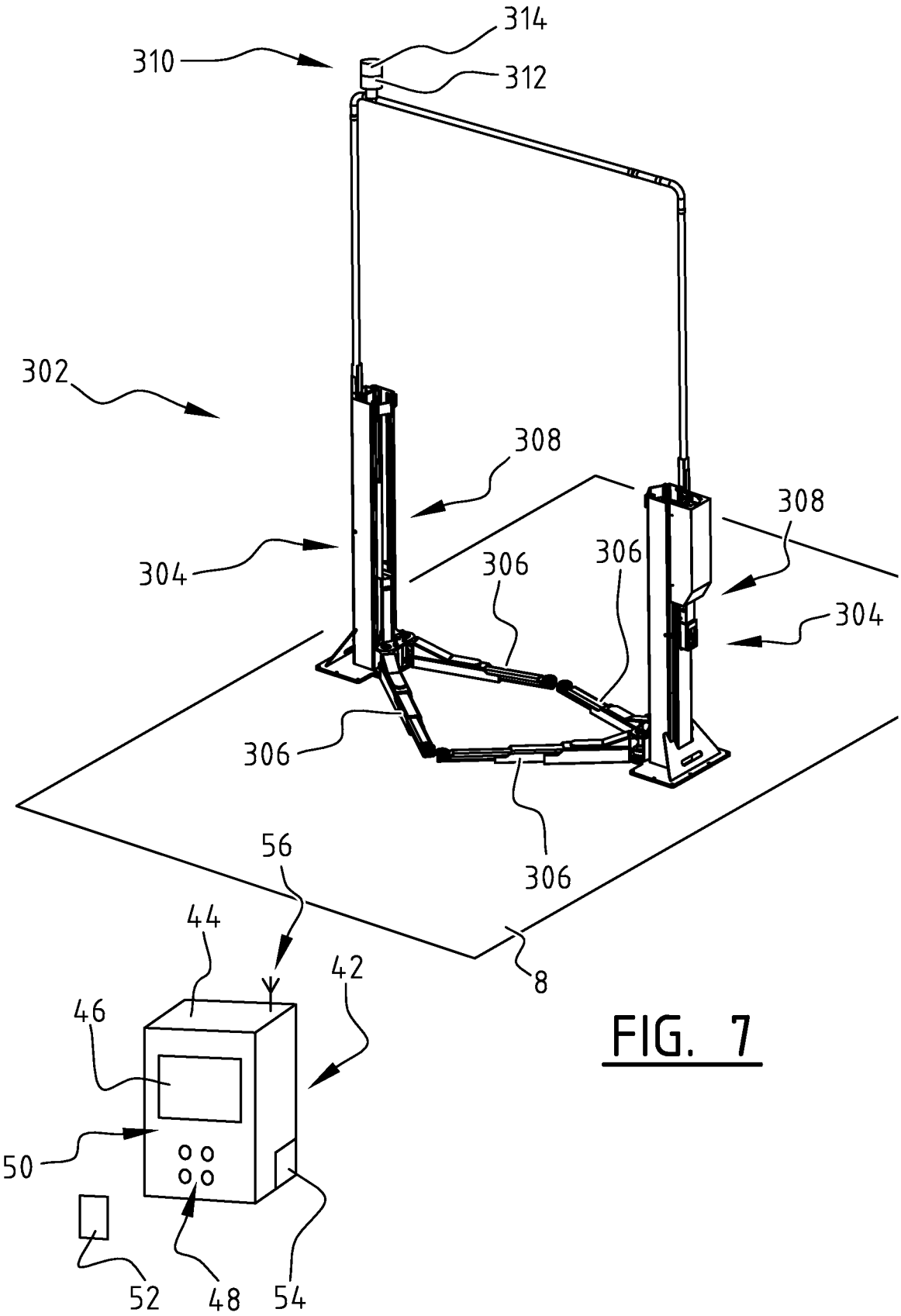

As an even further example, lifting system 302 (FIG. 7) comprises a so-called two-post configuration with two posts 304 that are provided with carrier arms 306. In the illustrated embodiment to measure position and speed of carrier arms 306 sensor 308 is provided. This enables the check on positioning of arms 306 as described earlier. A light 310 with green 312 and red 314 lights can be provided to indicate to the driver of vehicle 6 that the vehicle is positioned correctly or needs to be repositioned.

In the illustrated embodiments control system 42 can be applied obviously including lifting system type specific adaptations.

Figure 8A:
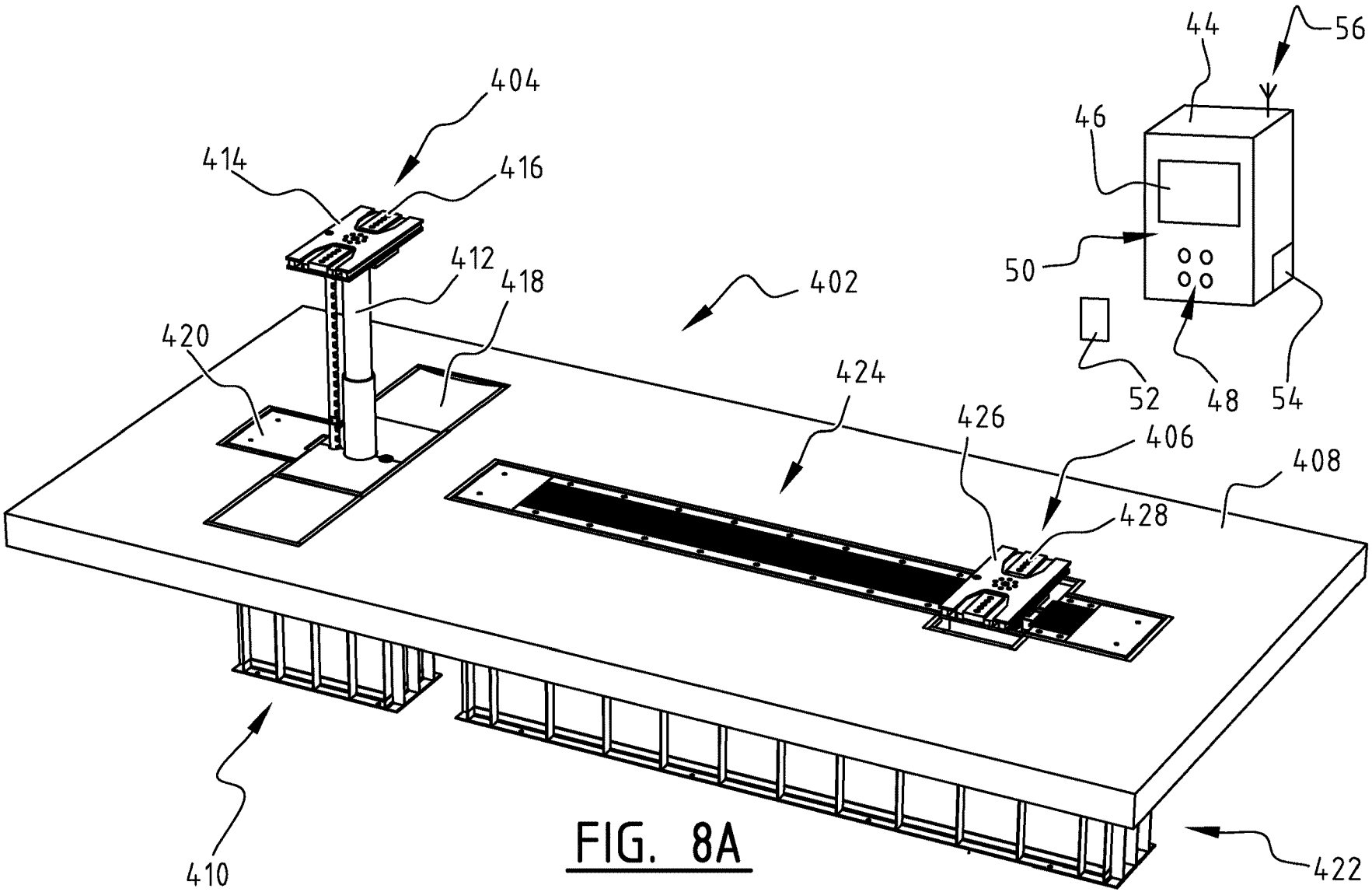
FIGS. 8A-B and 9 show further alternative in-ground embodiments of lifting devices of a lifting system according to the invention.
Figure 8B:
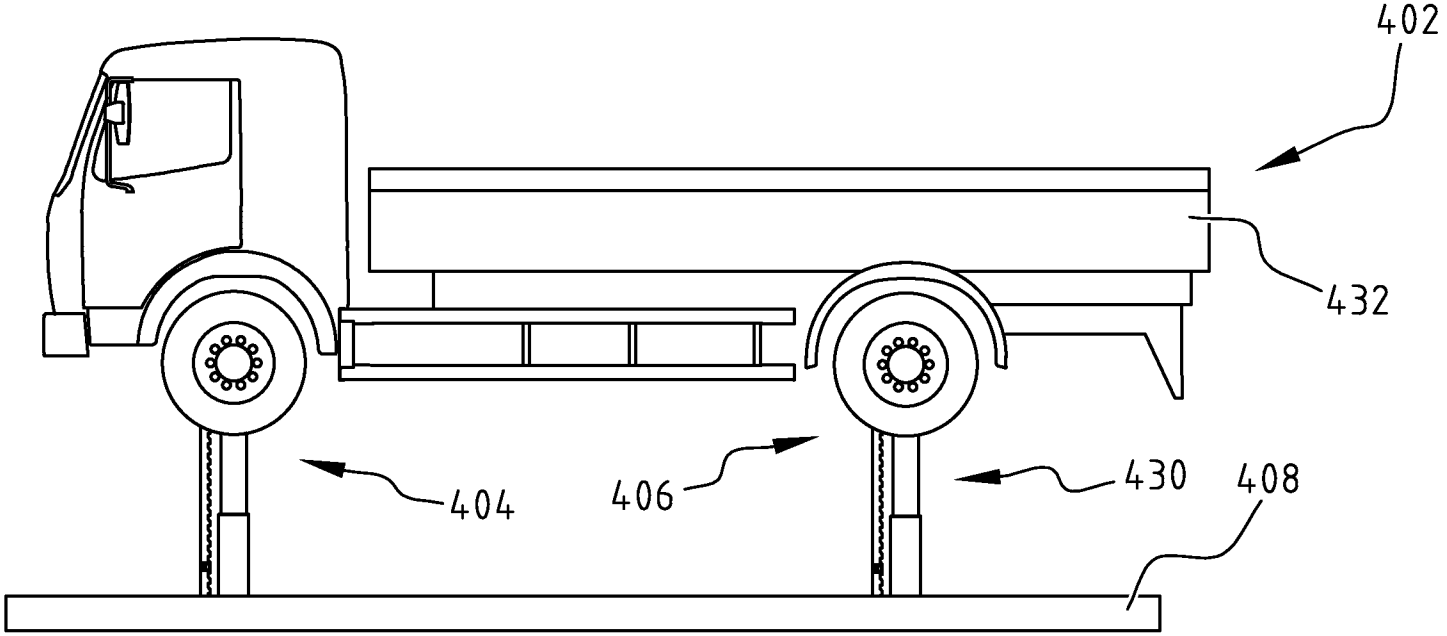

In a further alternative embodiment lifting system 402 (FIG. 8A-B) is of the in-ground lift type comprising stationary lifting column/device 404 and a moveable lifting column/device 406 that are located on or in floor 408. The front lifting column/device 404 is provided in cassette or box 410 with a telescopic lifting cylinder 412. On top of cylinder 412 there is provided carrier 414 with axle carriers 416. In the illustrated embodiment wheel edges or wheel recesses 418 are provided. Recesses 418 define the position of the front wheels of the vehicle. Furthermore, in the illustrated embodiment a hatch 420 is provided in front of the front lifting column/device 404 for maintenance, for example.

The moveable lifting column/device 406 moves in cassette or box 422 comprising a telescopic lifting cylinder 430. Box 422 provides a pit with a slot or recess 424 for guiding the moveable lifting column/device 406. Moveable lifting column/device 406 is provided with carrier 426 whereon axle carriers 428 are mounted. Depending on the type of vehicle 432 additional adapters can be provided that cooperate with carriers 414, 426 to enable engagement with different axle dimensions.

Figure 9:
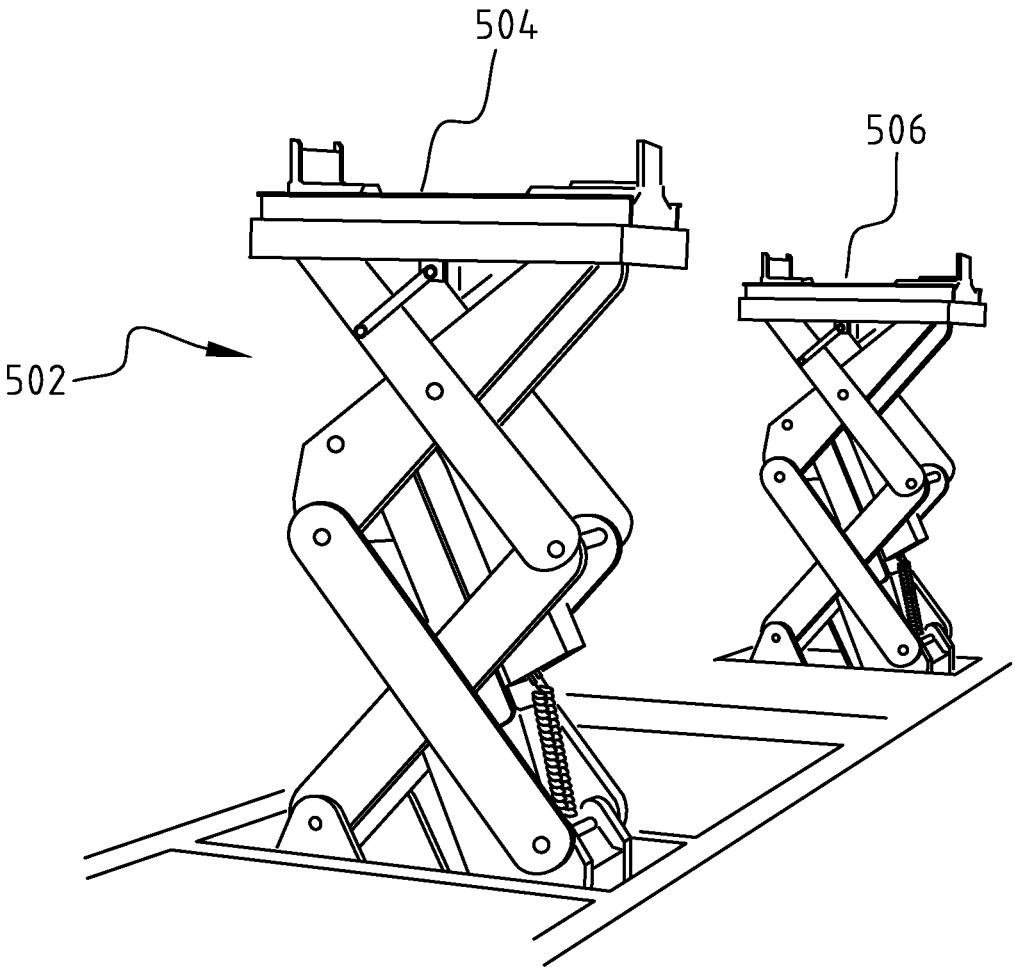

In an alternative lifting system 502 of the in-ground type (FIG. 9) the telescopic lifting cylinders 412, 430 of lifting system 402 are replaced by scissor type lifts 504, 506. It will be understood that operation of lifting systems 402, 502 of the in-ground type is similar.

It will be understood that the invention can be applied to a range of lifting systems, including but not limited to four-post and two-post lifting columns, such as the Stertil-Koni one post lifts ST1075, the Stertil-Koni two post lifts SK 2070, and the Stertil-Koni four post lifts ST 4120, skylift, mobile columns, and in-ground lifts, such as the Stertil in-ground Ecolift and the Stertil in-ground Diamond lift. Also, it will be understood that additional embodiments of the invention can be envisaged combining and/or switching features from the described and/or illustrated embodiments. For example, instead of light 110, 210, or in addition thereto, sound signals, indications on a control system etc. can be applied.

The present invention is by no means limited to the above described preferred embodiments. The rights sought are defined by the following claims within the scope of which many modifications can be envisaged. The present invention is described using a lifting device such as a lifting column and more specifically a mobile lifting column. The invention can also be applied to other type of lifting columns such as so-called boom-lifts, scissor-lifts and loading platforms. Such lifting equipment can be provided with the measures illustrated above according to the invention.

The invention claimed is:

1. A lifting system for lifting a vehicle comprising one or more lifting devices, each lifting device comprising:
- a frame with a carrier configured for carrying the vehicle;
- a drive for driving the carrier in at least one of an ascent or decent of the carrier;
- a sensor for measuring at least one of the ascent or descent of the carrier; and
- a controller comprising:
  - connection for connecting to the sensor;
  - a release system for releasing the carrier enabling the lifting system to lift the vehicle; and
  - an input for receiving a clearance signal from a clearance system,
- wherein the controller is configured to put the lifting system into operation after receipt of the clearance signal by releasing the lifting system, wherein the clearance system collects payment or debiting data from a user in order to enable a direct coupling of the lifting system to the user after the clearance system receives the payment or debiting data,
- wherein the sensor comprises an activity sensor configured for providing the controller with information on an actual use of the lifting system, wherein the activity sensor is configured to directly or indirectly sense movement of the carrier, and
- wherein the activity sensor enables a direct coupling of a lifting operation for a specific vehicle to a cost associated with using the lifting system based on a load of the specific vehicle,
- wherein the clearance system provides the clearance signal in response to at least one of receiving and generating payment instructions.

2. The lifting system according to claim 1, wherein the sensor comprises a displacement sensor for measuring a displacement of the carrier.

3. The lifting system according to claim 1, wherein the sensor comprises a load sensor.

4. The lifting system according to claim 1, wherein the sensor comprises a pump activity sensor.

5. The lifting system according to claim 1, wherein the sensor comprises a motor run time sensor.

6. The lifting system according to claim 1, further comprising a vehicle detector.

7. The lifting system according to claim 1, wherein the controller comprises at least one of a transmitter and a receiver for remotely controlling the release system.

8. The lifting system according to claim 1, wherein the controller comprises a communication optimiser for determining an appropriate communication route in the lifting system.

9. A method for controlling a lifting system for lifting a vehicle comprising the steps:
- providing a lifting system according to claim 1; and
- controlling the lifting system with the controller and providing a release signal to the lifting system releasing the carrier with the release system thereby enabling the lifting system to lift the vehicle.

10. The method according to claim 9, wherein the release signal is provided after receiving a clearance signal from a clearance system.

11. The method according to claim 10, wherein the clearance system provides the clearance signal in response to at least one of receiving and generating payment instructions.

12. The method according to claim 11, wherein the clearance signal comprises a payment.

13. The method according to claim 12, further comprising determining an appropriate communication route in the lifting system with a communication optimiser.

14. The method according to claim 9, further comprising determining an appropriate communication route in the lifting system with a communication optimiser.

15. The lifting system according to claim 1, wherein the clearance signal comprises a payment.

16. A lifting system for lifting a vehicle comprising one or more lifting devices, each lifting device comprising:
- a frame with a carrier configured for carrying the vehicle;
- a drive for driving the carrier in at least one of the ascent or decent of the carrier;
- a sensor for measuring at least one of an ascent or descent of the carrier; and a controller comprising:
  - a connection for connecting to the sensor;

a release system for releasing the carrier enabling the lifting system to lift the vehicle; and an input for receiving a clearance signal from a clearance system, wherein the controller is configured to put the lifting system into operation after receipt of the clearance signal by releasing the lifting system, wherein the clearance system collects payment or debiting data from a user in order to enable a direct coupling of the lifting system to the user after the clearance system receives the payment or debiting data, wherein the sensor comprises an activity sensor configured for providing the controller with information on an actual use of the lifting system, wherein the activity sensor is configured to directly or indirectly sense movement of the carrier, and wherein the activity sensor enables a direct coupling of a lifting operation for a specific vehicle to a cost associated with using the lifting system based on a load of the specific vehicle, wherein the clearance system provides the clearance signal in response to at least one of receiving and generating payment instructions.

17. The lifting system according to claim 16, wherein the sensor comprises a motor run time sensor.

* * * * *